United States Patent [19]

Francis

[11] Patent Number: 4,799,344

[45] Date of Patent: Jan. 24, 1989

[54] MECHANICAL-ADHESION GLAZING

[75] Inventor: Geoffrey V. Francis, Brampton, Canada

[73] Assignee: Vision Engineering & Design, Inc., Oakville, Canada

[21] Appl. No.: 68,034

[22] Filed: Jun. 29, 1987

Related U.S. Application Data

[63] Continuation-in-part of Ser. No. 749,655, Jun. 28, 1985, abandoned.

[51] Int. Cl.[4] ..... E04B 2/28

[52] U.S. Cl. ..... 52/235; 52/397; 52/403; 52/790

[58] Field of Search ..... 52/235, 403, 402, 395, 52/393, 788, 789, 790, 821, 827, 397, 398, 202, 203

[56] References Cited

U.S. PATENT DOCUMENTS

| | | | |
|---|---|---|---|
| 3,553,918 | 1/1971 | Danson | 52/208 |
| 3,672,107 | 6/1972 | Santry et al. | 52/235 |
| 3,844,087 | 10/1974 | Schultz et al. | 52/208 |
| 3,866,374 | 2/1975 | Dallen | 52/208 |
| 4,307,551 | 12/1981 | Crandell | 52/235 |
| 4,464,874 | 8/1984 | Shea, Jr. et al. | 52/398 |
| 4,500,572 | 2/1985 | Francis | 52/172 |
| 4,545,161 | 10/1985 | Baumann | 52/235 |
| 4,567,710 | 2/1986 | Reed | 52/790 |

*Primary Examiner*—David A. Scherbel
*Assistant Examiner*—Caroline D. Dennison
*Attorney, Agent, or Firm*—Krass & Young

[57] ABSTRACT

An architectural glass unit comprises a glass light having an inner surface and a flexible structural gasket extending along edges of the glass light and located adjacent the inner surface. A thin adhesive layer bonds the glass light firmly to the structural gasket. A supporting frame extends along the same edges of the glass light and is located on the side of the gasket opposite the glass light. This frame includes means for mechanically fastening the structural gasket to the frame. In one embodiment, a bonding material such as structural silicone directly bonds the glass light to the supporting frame and is arranged along one side of the gasket. L-shaped flanges integrally formed on the frame and rolled into sealing engagement with the gasket are used for the mechanical fastening.

23 Claims, 4 Drawing Sheets

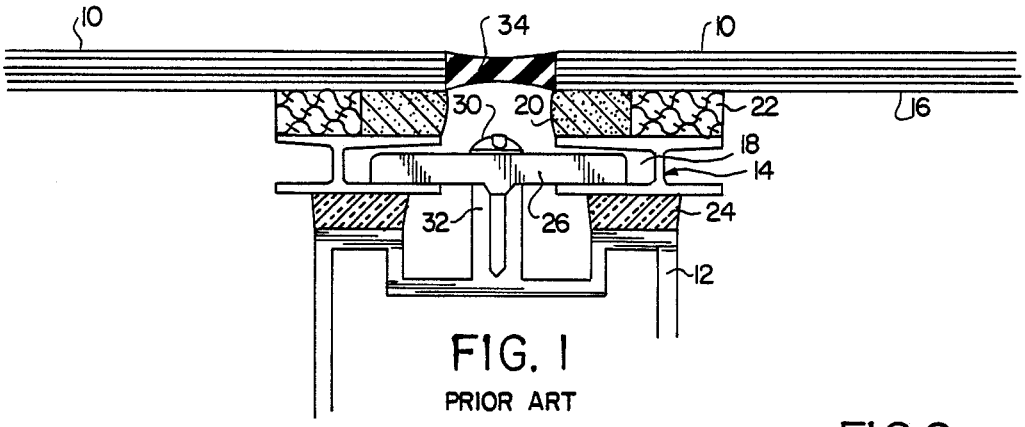
FIG. 1
PRIOR ART
FIG.2
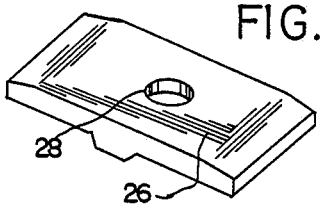
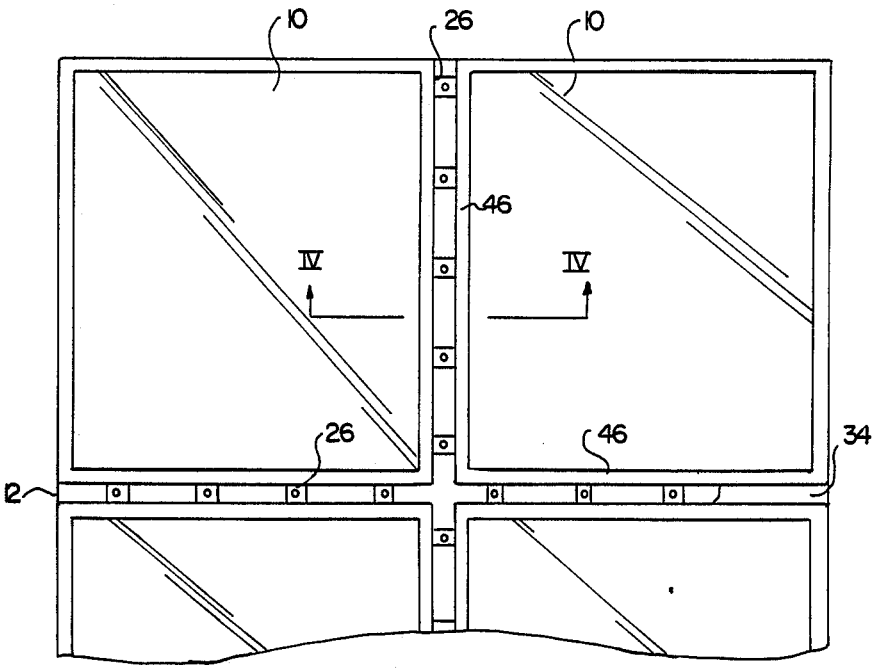
FIG. 3

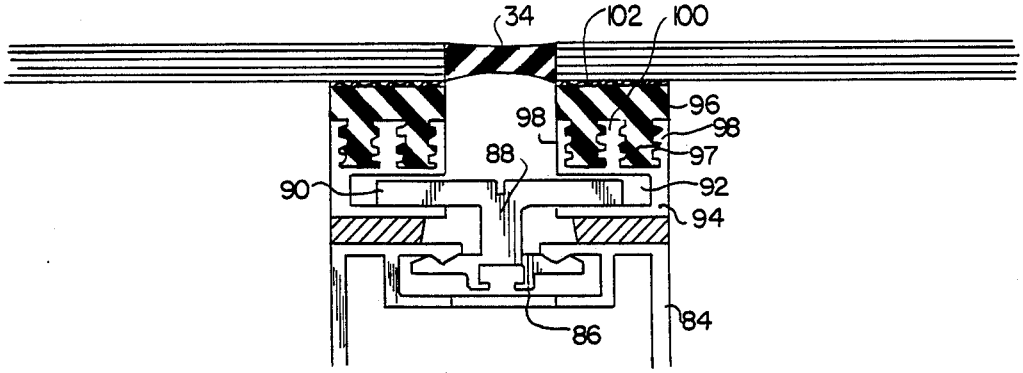
FIG. 7
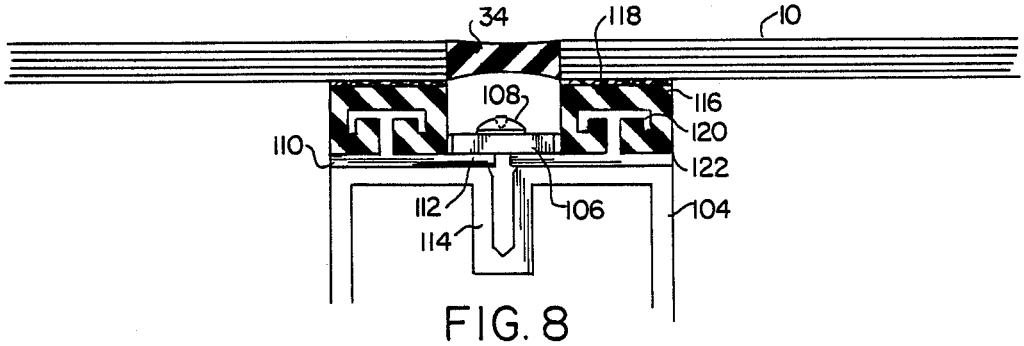
FIG. 8
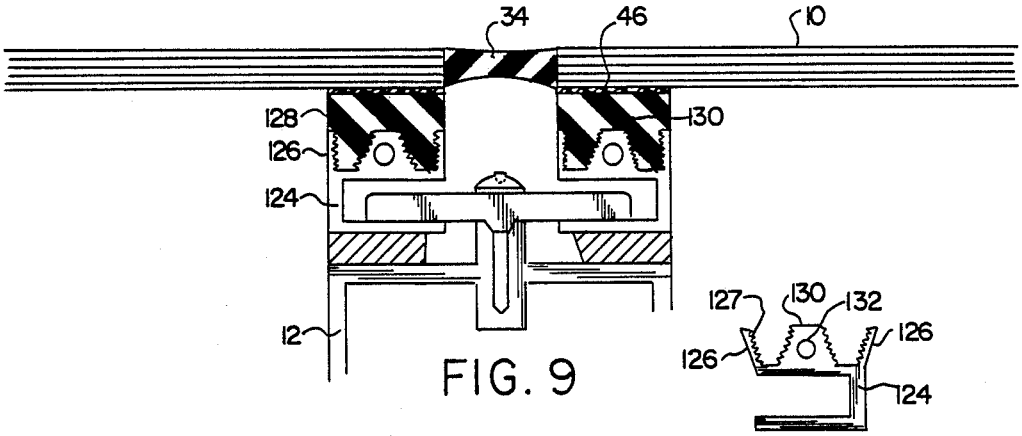
FIG. 9
FIG. 10

MECHANICAL-ADHESION GLAZING

RELATED APPLICATION

This is a continuation-in-part of U.S. Ser. No. 749,655, filed June 28, 1985, abandoned.

BACKGROUND OF THE INVENTION

This invention relates to glazing and in particular a system for attaching such glazing to a window frame or mullion.

Various arrangements are known or have been proposed for mounting and supporting single layer glass plates or lights or double layer sealed units in a framework or mullion without exterior stops or caps. Mounting windows in this manner is sometimes known as "flush" glazing. The interior light of a sealed unit or the single sheet of glass can be adhered to the mullion frame in situ or, alternatively, the glass can be adhered to a framework in a factory and then the total combination can be clipped or bolted in place.

In one known method of attachment, the glass light is attached to a metal frame by means of a structural silicone strip and an adjacent compatible tape strip that may be sticky on both sides. The frame has an elongate channel-shaped slot extending along an outwardly facing side thereof, which slot is capable of receiving the end portions of a number of clips that can be used to attach the frame to a main frame or mullion.

Another method for attaching glass plates or sealed glass units to a window frame is that employing a glazing gasket having a H-shaped cross section. Such glazing gaskets are sold by Standard Products Company in the United States. These gaskets which are made from Neoprene sold by Dupont have a separate locking strip that is ten points harder in durometer (shore A) than the gasket itself. The gasket can have a toothed or ribbed extension on one side for attaching the glazing to a window frame. Adjacent edges of two glass sheets or glass units are inserted into the two main cavities of the gasket. In order to attain the sealing pressures which are required to secure and seal the glass panels to the frames, the locking strip is inserted progressively with a special tool into a groove that extends along the length of the gasket.

Other methods for attaching sealed glass units to a window frame are disclosed in applicant's U.S. Pat. No. 4,500,572 issued Feb. 19, 1985. In the system of this patent, the spacers which separate and join the two glass plates are adapted for connection of the unit to adjoining frame members. The spacer has sections forming a channel shaped recess, open along the edge of the unit. Connectors or clips can be used to attach the spacer member to the frame. Alternatively, the spacer can have an extension that extends beyond the edge of the glass unit, which extension is attached by means of screws or clamping plates or both to the mullion frame.

One of the major problems arising from currently used structural silicone glazing or flush glazing is that silicone is difficult to adhere to aluminum or steel. Moisture can penetrate the silicone and slowly cause oxidation of the metal surface and this will eventually affect adhesion. In order to prevent oxidation, the metal surface must generally be treated. In this case of aluminum, the metal is either anodized or painted. Anodizing produces an even oxidized surface which can produce a good surface for adhesion. However, often microscopic surface irregularities contain contaminants which will affect adhesion. Although paint finishes can also produce good adhesion surfaces, commercial formulations are constantly changing, resulting in an alteration in adhesion characteristics. Further, the adhesion of the paint itself must carry the loads on the window and, if the paint is poorly applied, it can peel off.

Another difficulty with current structural silicone glazing is that any small traces of oil from the manufacturing and fabrication process can destroy the adhesion of this material. Accordingly, the surface must be very carefully cleaned prior to application of the silicone and this is not always successful. The most commonly used silicone (acetoxy curing type) also requires that a primer or adhesion promoter be applied to the metal. This operation is difficult as a very thin layer of clean primer must be deposited on the metal surface. In fact, too much primer is almost worse than too little for this purpose. Unlike metal, a glass surface does not need a primer for silicone to adhere to it.

Recent U.S. Pat. No. 4,567,710 issued Feb. 4, 1986 to Michael R. Reed teaches a method of adhering plastic face sheets to a metal I-beam grid core, by the use of plastic connectors. The purpose of the plastic connectors is to improve the thermal insulation of the sandwich panel and to reduce the stresses on the adhesive bond by closely matching the thermal expansion of the face sheets and the connector. The connector material is described as preferably a rigid polyester resin formulation as used in the Fiberglas face sheets. The connectors are fixed to the metal I-beam core by sliding fit. The adhesive stresses in sandwich panels of this nature are almost all produced by differential thermal expansion. On the other hand glass units incorporating the present invention are suitable for large flush glazed glass lites which are typically fixed on high-rise buildings. Under these circumstances, the majority of the adhesive stresses at the perimeter of the glass unit are produced by wind loads and building mvoements, not differential thermal expansion.

It is an object of this invention to provide an improved glass panel unit for use on a building exterior wherein the glass light or panel member is attached to an adjoining frame by means of an elongate elastomeric gasket and wherein this gasket is reliably and securely fastened to the frame.

It is another object of the present invention to provide an improved glass unit that can be used for flush glazing and that provides an effective and reliable means for attaching the glass light to the adjoining frame.

It is a further object of the present invention to provide an improved panel unit for use on a building exterior wherein the panel member is attached to an adjoining frame by means of a flexible gasket and wherein the structural gasket is reliably and securely fastened to the frame.

SUMMARY OF THE INVENTION

According to one aspect of the invention, a glass unit comprises glass light means having an inner surface and a flexible gasket of elastomeric material extending along edges of the glass light means and located adjacent the inner surface. A thin adhesive layer bonds the glass light means firmly to the structural gasket. A supporting frame extends along the same edges of the glass light means and is located on the side of the structural gasket opposite the glass light means. This frame includes means for mechanically fastening the structural gasket to the frame.

In one preferred embodiment, there are means for directly bonding the glass light means to the supporting frame. This direct bonding means is arranged along one side of the gasket. Preferably, the bonding means comprises a strip of structural silicone located outwardly from the structural gasket so that the strip is closer to the respective edges of the glass light means than the gasket.

According to another apsect of the invention, a panel unit for use on a building exterior comprises a panel member having an inner surface and flexible structural gasket extenidng along edges of the panel member and located adjacent the inner surface. A thin adhesive layer bonds the panel member firmly to the structural gasket. A supporting frame extends along the same edges of the panel member and is located on the side of the gasket opposite the panel member. The frame includes means for mechanically fastening the structural gasket to the frame.

According to a further aspect of the invention, a glass unit comprises glass light means having an inner surface and a flexible elastomeric gasket extending along edges of the glass light means and located adjacent the inner surface. This gasket has a longitudinally extending recess along one side thereof adapted to receive part of a supporting frame member. This one side of the gasket is adjacent the respective edge of the glass light means and extends perpendicular to the inner surface. The structural gasket also has a longitudinally extending groove along one side thereof. A thin adhesive layer bonds the glass light means firmly to the gasket. There are also elongate locking strip means having a length corresponding to that of the groove and a cross section sized and shaped to permit the strip means to fit snugly in said groove and to thereby firmly attach the gasket to the supporting frame member. The groove has a cross-sectional shape formed to retain the locking strip in said groove after said strip is inserted therein.

Overall, the invention provides essentially for the creation of an externally flush glass appearance and for the mechanical integration of a sub-frame and elastomeric gasket; wherein the gasket is of sufficient size and elasticity as to itself accommodate relative movements between the glass and sub-frame without destructively stressing the adhesive bond between gasket and glass. All of this is done, of course, without the need for devices to allow sliding motion.

Further features and advantages will become apparent from the following detailed description of preferred embodiments when considered in conjunction with the accompanying drawings.

BRIEF DESCRIPTION OF THE DRAWINGS

FIG. 1 is a sectional view of a known method for attaching glass plates to a window frame by means of clips;

FIG. 2 is a perspective view of one of the clips used to attach the glass plates shown in FIG. 1;

FIG. 3 is a side view showing a couple of glass plates and parts of two others attached according to the system of the present invention;

FIG. 7 is a sectional detail similar to FIG. 4 but showing another embodiment wherein a different form of clip is employed to attach a sub-frame to a main mullion;

FIG. 8 is a sectional detail of another embodiment wherein screws are used to attach a clamping plate;

FIG. 9 is a sectional detail of still another embodiment wherein clips are used to attach the glass plate units to the mullion;

FIG. 10 is a detailed view showing the cross section of the sub-frame of FIG. 9 prior to attachment of the flexible gasket;

DETAILED DESCRIPTION OF PREFERRED EMBODIMENTS

Figure 4:
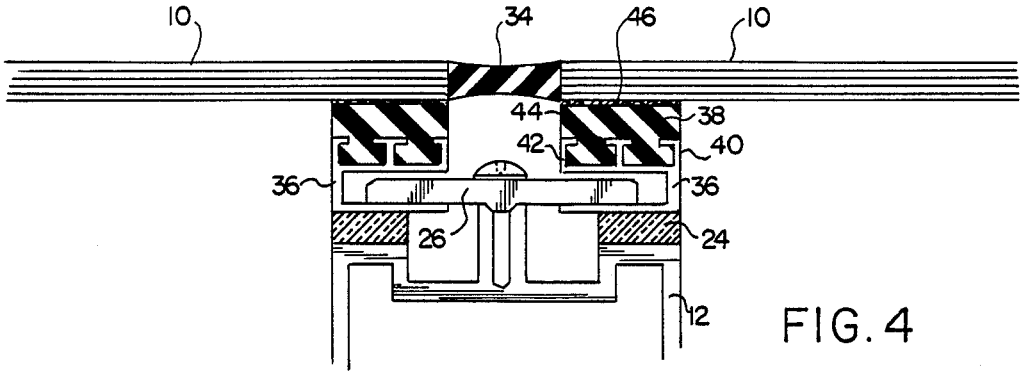
FIG. 4 is a cross-sectional view taken along the line IV—IV of FIG. 3.

FIGS. 1 and 2 of the drawings illustrate a commonly used method for mounting glass plates or lights 10 to a mullion or window frame 12 without the use of an exterior stop or cap. In the embodiment FIG. 1, each glass light 10 is connected to a sub-frame 14 that extends around the periphery of the inner surface 16 of the light. The sub-frame 14 is generally U-shaped in cross section so that it has a slot 18 that is open towards the edge of the unit. The sub-frame is connected to the glass plate by a bead of structural silicone 20 and by a compatible tape 22 that is usually sticky on both sides and acts as a backer for the silicone. The thickness of the silicone bead is generally from 5 to 10 mm. It will be further appreciated that in order to provide a good bond between the silicone 20 and the sub-frame, the latter must have a surface treatment, at least on the surface adjacent the bead of silicone. As explained earlier, if the sub-frame 14 is made of aluminum, the metal is usually either anodized or painted.

Arranged between the sub-frame 14 and the mullion 12 is a suitable glass seat 24. For attachment of the glass units, they are initially put in place on their respective glass seats 24. One method of fixing the sub-frame 14 in position is by a number of flat clips 26 which can be inserted through the gap formed between adjacent glass plates. The inserted clips are turned about their central axis so that the ends of the clips project into the slots 18 of adjacent glass units. Each clip has a hole 28 in the center thereof through which extends a threaded fastener 30. The clip 26 rests on an outward extension 22 of the mullion. This extension has a hole or slot for passage of the threaded fastener 30. Alternatively, a separate sleeve or bar can be provided between the center portion of the clip and the mullion. After the window unit has been attached to the mullin by the use of a number of the clips 26 (that are distributed around the periphery of the unit) a weather seal 34 can be applied and this seal extends between the adjacent edges of the plates 10.

FIG. 3 illustrates two full glass plates or lights 10 as well as parts of two further lights 10. These lights are connected to a mullion or window frame 12 by means of the aforementioned flat clips or plates 26. The plates 10 are attached to the mullion in accordance with the present invention as illustrated in cross section in FIG. 4.

A supporting frame or sub-frame 36 extends around the periphery of each glass ligth 10 and it is connected thereto by a flexible structural gasket 38 of elastomeric material which also extends along the perhiphery of the glass light. The structural gasket is connected by mechanical fastening means to the sub-frame. In the embodiment of FIG. 4, L-shaped flanges 40 and 42 are formed on the side of the sub-frame that faces the glass light. In addition, in the illustrated embodiment there is a T-shaped central connector 44 extending longitudinal along the frame. In order to connect the frame 36 to the structural gasket, the L-shaped flanges which initially (after extrusion) are angled outwardly are rolled into sealing engagement with the gasket so that they assume the upright position shown in FIG. 4. The structural gasket is attached in a very secure manner to the inner surface of the glass light by a thin adhesive layer 46. In the present invention, the thin layer 46 can range in thickness from that of a single molecule up to 2 mm. For many types of adhesive the thickness of the layer would range between 0.1 to 0.5 mm, considerably less than the thickness of the presently used silicone in known window constructions. In the usual manner, a glass seat 24 is arranged between the sub-frame 36 and the mullion 12.

It will be appreciated that because the present system relies on a mechanical engagement between the structural gasket 38 and the sub-frame, there is no need for the sub-frame to have a special surface treatment prior to use and this will of course reduce the cost of manufacturing and installing these units significantly.

Turning now to the specific construction and make-up of the components of the present glass unit, the preferred flexible gasket 38 is a high strength elastic rubber gasket extrusion that can be made from heat cured silicone or Neoprene. A tensile strength in the order of 250 to 500 psi is satisfactory for the structural gasket depending upon the mechanical fixing detail. The material must be stable after long term exposure to ultraviolet light and it should be flexible over a range of temperatures extending from −30° C. to 80° C. The material should have good tear resistance. It can be of the "sponge" type in its construction. The gasket material is elastomeric and preferably has a modulus of elasticity when tested in the gasket configuration of less than 1000 pounds per square inch. The gasket itself should have a tension stiffness less than 2000 ponds/inch/inch which will result in a gasket having the required shear stiffness.

The adhesive layer 46 must also be stable after long term exposure to ultraviolet light and it should withstand a temperature range extending from −30° C. to −80° C. (the precise range depending upon expected temperature conditions in the region where the window unit is to be installed). Furthermore, it should be compatible with the flexible structural gasket material that is to be used.

Although prior art glazing constructions employing structural silicone were necessarily limited to either a chemical plural component cure (Class 1A) or a chemical moisture cure (Class 1C) type, with the material being applied by a caulking gun, the use of a relatively thin layer of adhesive, as in the present invention, permits many classes of adhesives and various application techniques to be employed. The classes of adhesives which may be used with the present invention all into the generally category of "synethetic" organics. This includes silicone polymers which, strictly speaking, should be classified as in organics. This categroy may be further classified by curing methods or the manner in which they convert from the liquid to the solid state during bonding. The classes of adhesives which may be used with the present invention are as follows:

I Chemically Reactive
- IA Plural component
- IB Heat activated
- IC Moisture cure II Evaporative IV Delayed-Tack V Film (with different adhesive properties on the two sides, if necessary)

VI Pressure Sensitive

The adhesive may be applied according to one of several methods including by roller, brush, spray, film, and extrusion or caulking gun. The method of application will depend on the particular adhesive to be used. Preferably, the adhesive bond is of the chemical molecular linkage type which is the type provided by such materials as epoxy and silicone. From a practical point of view the bond should be achieved quickly. This is possible by using a two part adhesive (i.e., adhesive and cure agent) where the parts are mixed together prior to application of the adhesive from Dow Corning under number 982 or General Electric under number 3204 are examples of products that could be used for the present purpose.

Another method of achieving a fast cure when a thin adhesive layer is used is to manufacture the adhesive with a cure inhibitor mixed in. After application of the adhesive an energy source such as infrared light is introduced and this drives off the inhibitor so that a bond is achieved. The energy source could take the form of heat, light, pressure, electricity or combinations thereof. The required tensile strength of the adhesive material is approximately 80 psi as a minimum.

The sub-frame 36, as in the case of known subframes, can be an aluminum extrusion although roll form steel or aluminum could conceivably be used. Aluminum alloy 6063-T5 is an ideal material for this purpose. As indicated above, after extrusion, the sub-frame is run through roller dies which force the L-shaped flange 40,42 inwards to clamp the gasket 38 in place.

With respect to the glass itself, although single layer glass lights or panels 10 are shown in the drawings, it will be appreciated by those skilled in the art that insulating glass such as double glazing sealed units could readily be used with the present invention. Furthermore, metal panels could also be connected in the same manner to the building frame. It is expected that the primary use of units constructed in accordance with the invention will be in the commercial glazing industry, particularly when flush glazing is desired or required. In addition to architectural glazing, the invention can also be used for automobiles and other vehicles. Fixed car windows can benefit from the present design as car designers are attempting to produce smooth surfaces to minimize the drag coefficient.

It will be further appreciated that the constructon of the present invention provides several advantages for the glazing industry. The flexible structural gasket 38 provides the necessary movement capability (which movement may be required because of changing temperature conditions, sudden changes in pressure and wind conditions and building movements). The thin layer of adhesvie 46 provides the necessary secure and reliable bond which prevents any sudden failure that could result in the glass light falling from its supporting frame. The adhesive layer 46 is strong and dependable because adhesion to glass and to gasket material is normally very reliable.

Figure 5:
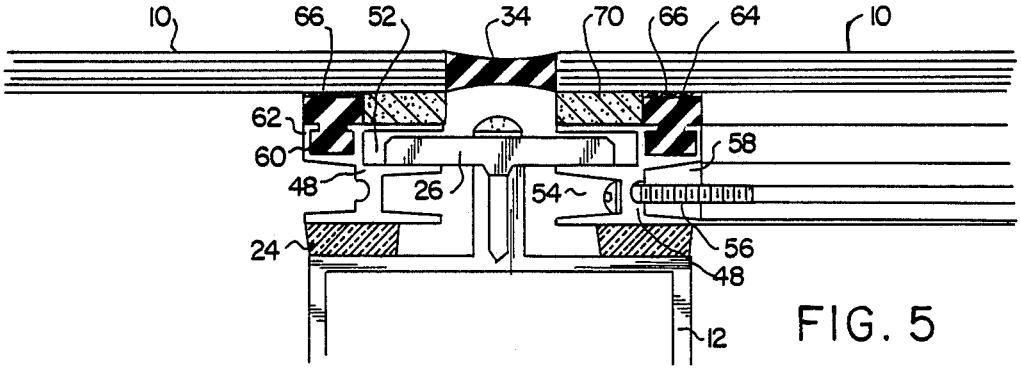
FIG. 5 is a cross-sectional view similar to FIG. 4 but showing the use of an additional sealant.

Turning now to the embodiments illustrated in FIG. 5, in this embodiment there are two alternative loads paths for holding the glass light 10 in place.

The sub-frame 48 has a first slot 52 adapted to receive the end of the clip 26. It has a second elongate slot 54 into which can be inserted suitable screws 56 that are used to attach the sub-frame 48 at its corners. In the side of the sub-frame is a third, wider slot 58 through which can pass part of the screws 56 as shown. Located along the side of the sub-frame closest to the inner surface of the glass light 10 is an elongate groove 60, part of which is defined by L-shaped flange 62. Thus a flexible structural gasket 64 is mechanically fastened to the sub-frame 48. This is accomplished by rolling the L-shaped flange 62 into engagement with the gasket after extrusion of the sub-frame. A thin adhesive layer 66 firmly bonds the structural gasket 64 to the inner surface of the glass light. In addition, in this embodiment there are means for direcly bonding the glass light 10 to the sub-frame 48. The illustrated bonding means, which is arranged along one side of the gasket 64, is a strip of structural silicone 70. The strip of silicone 70 is located outwardly from the structural gasket so that the strip is closer to the respective edges of the glass light 10 than the gasket. It will be appreciated that if the gasket connection between the sub-frame and the glass light should fail for any reason, the structural silicone strip 60 can still hold the glass light in place, thus minimizing the risk of the glass light falling from its frame. Alternatively, if the silicone bond should fail, the structural gasket connection can still hold the glass light in place. As explained earlier, the sub-frame in the region of the silicone strip 70 should be surface treated so as to provide good adhesion. Again, a weather seal 34 is preferably provided between the edges of adjacent glass lights.

Figure 6:
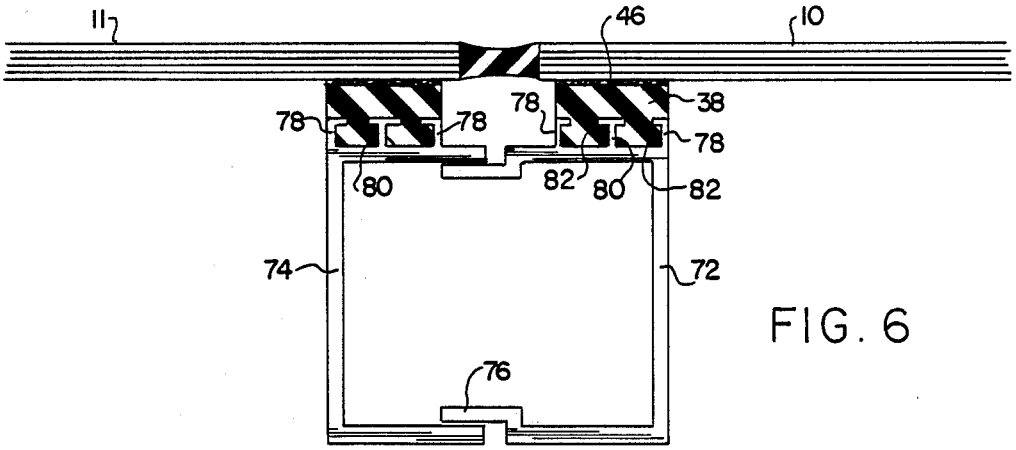
FIG. 6 is a sectional detail similar to FIG. 4 but showing another embodiment of the present invention.

Another embodiment of the invention which does not employ clips is shown in part in FIG. 6. In this example, the glass light 10 is connected to a section 72 of the main mullion. The adjacent glass light 11 is connected to another section 74 of the main mullion. The two sections 72 and 74 can be joined by an interlocking connection 76. Formed on each of sections 72 and 74 are L-shaped flanges 78 and T-shaped central connectors 80. The flexible structural gaskets 38 are essentially the same as those shown in FIG. 4. Again, a thin layer of adhesive 46 securely bonds each gasket 39 to the light 10, 11.

The frame sections 72 and 74 can be aluminum extrusions. Prior to attachment of the structural gasket 38, the L-shaped flanges 78 are angled outwardly so that the downwards extension 82 of each gasket 38 can be inserted between the L-shaped flanges and the central connector 80. When the gasket is in place, the L-shaped flanges are then rolled into the upright position shown. The glass lights 10 and 11 are bonded to their respective gaskets before the frame sections are installed in the building.

FIG. 7 illustrates another embodiment which is connected to a mullion frame 84 by means of another form of connector 86. A connector 86 is described in applicant's U.S. Pat. No. 4,500,572, the disclosure of which is incorporated herein by reference. It has a stem portion 88 and two generally flat arms 90 projecting from one end of the stem portion. The thickness of these arms must be less than the width of a slot 92 formed in the side of a sub-frame 94. Again, each sub-frame 94 is mechanically connected to a flexible structural gasket 96. For this purpose, the sub-frame has ribbed flanges 98 and a centrally located, ribbed connector or flange 100. The ribs extend longitudinally along the flanges and the connector and are on the side thereof that engages two ribbed downward extensions 97 of the structural gasket 96. The shape of the ribbed flanges 98 and extensions 97 is such that the gasket 96 can be securely fixed to the frame by pushing the extensions directly into the openings between flanges 98 and 100. A thin layer of adhesive is provided at 102. It will be understanding that prior to use of the connectors 86, the completed window unit including the sub-frame 94 is put in the required position on the mullion frame 84 and is set on setting blocks in the conventional manner. The clips can then be installed in the manner explained in the aforementioned U.S. Pat. No. 4,500,572.

FIG. 8 illustrates an embodiment wherein the window units are attached to the mullion frame 104 by means of an elongate clamping bar 106 of known construction. Bolts 108 or other suitable fasteners are used to attach the clamping bar to the frame. These bolts extend into holes in the mullion frame as explained in U.S. Pat. No. 4,500,572, the disclosure of which is incorporated herein by reference. In the embodiment of FIG. 8 each sub-frame 110 has an outwardly extending connecting flange 112 which in use is clamped between the bar 106 and the mullion frame 104. As with the previous embodiments, each sub-frame 110 is connected to a glass light 10 by means of a flexible structural gasket 116. A layer of adhesive 118 bonds the structural gasket to the glass light.

The sub-frame 110 has an outwardly projecting extension 120 that has a T-shaped cross section. On each side of this extension are inwardly extending flanges 122 which have been rolled inwards to engage tightly the gasket 116.

The embodiment of the invention shown in FIG. 9 and in part in FIG. 10 is substantially similar to that of FIG. 4 except for the construction of the sub-frame 124. The cross section of the sub-frame just after extrusion is shown in FIG. 10. The outer side of the sub-frame has outer flanges 126 that have clamping teeth 127 along their inner surfaces. The flanges 126 are angled outwardly as shown in FIG. 10 after extrusion. After a flexible structural gasket 128 has been put in place, the flanges 126 are rolled in so that they are in the upright position shown in FIG. 9. There is also a tooth-covered central rib 130 for engaging the structural gasket 128. The rib 130 can have a screw hole 132 used to fix the sub-frame 124 at the corners thereof. As in previous embodiments, the structural gasket 128 is attached to the glass light 10 by a thin layer of adhesive 46. The adhesive 46 is applied to the gasket and then the glass light is laid on top. If required the glass unit can then be passed through a heated area for a flash type cure.

Figure 11:
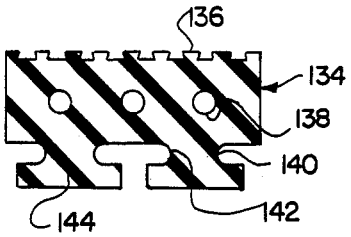
FIG. 11 is another detail view showing the cross section of a flexible structural gasket that can be used in the present invention.

FIG. 11 illustrates a flexible structural gasket 134 that can be used in the manufacture of glass units in accordance with the present invention. If desired, the upper surface of the gasket, that is the surface to be bonded to the glass light, can be keyed as indicated at 136. Such a surface will for some types of adhesive provide better adhesion between the structural gasket and the glass light. The flexibility of the structural gasket can be varied by the use of voids 138 or hollow spaces. In the illustrated embodiment there are three voids of circular cross section. The more void space provided through the length of the gasket, the more the flexibility of the gasket will be increased. FIG. 11 also illustrates the preferred use of rounded corners as at 140 and 142 in order to minimize local stresses, particularly in the region of the downward extensions 144 which are mechanically attached to the sub-frame as explained above.

Figure 12:
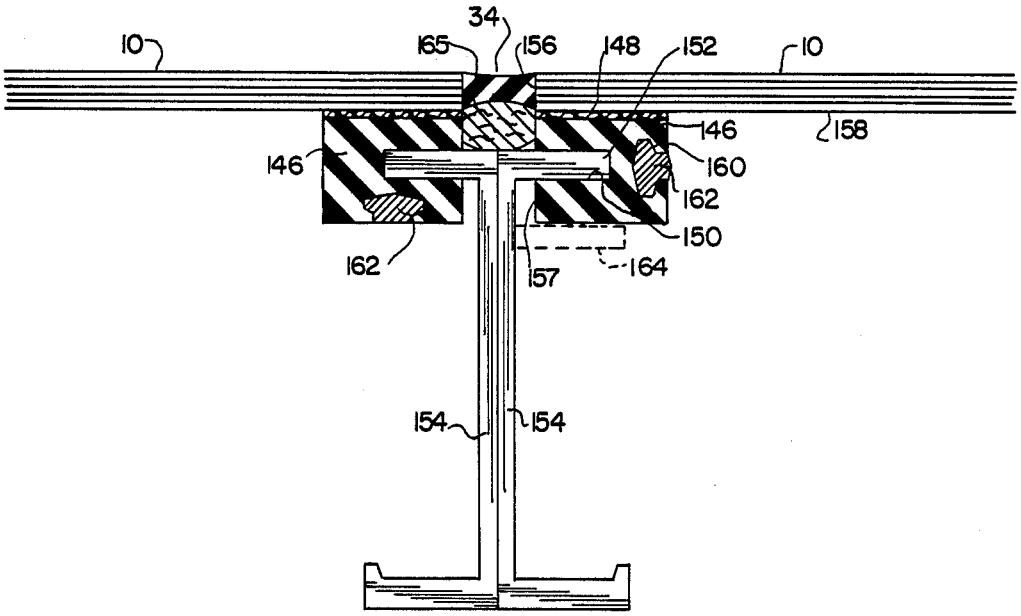
FIG. 12 is a sectional view showing a still further embodiment of the invention, which embodiment employs a two part structural gasket.

FIG. 12 illustrates a further alternative construction employing the present invention. As in the previous embodiments, a flexible structural gasket 146 is securely attached to the inner surface of the glass light by a thin layer of adhesive 148. The structural gasket 146 has a longitudinally extending recess 150 extending along one side thereof and adapted to receive an end part 152 of a supporting frame member or glazing bar 154. The side of the gasket having the recess 150 is adjacent a respective edge 156 of the glass light 10 and extends perpendicular to the inner surface 158 of the glass light.

The structural gasket 146 also has a longitudinally extending groove 160 along another side thereof. Elongate locking strip means 162 having a length corresponding to that of the groove 160 has a cross section sized and shaped to permit the strip to fit snugly in the groove as shown. A special known tool is used to force the strip 162 into the groove 160 and to thereby firmly attach the gasket to the supporting frame member. The groove 160 has a cross-sectional shape formed to retain the locking strip in the groove after the strip has been inserted. An alternate location for the strip 162 is shown on the left side of FIG. 12. In this configuration, the strip 162 is in a groove located on a side of the gasket opposite the inner surface 158 of the glass light and extending parallel thereto. Although locking strips of this type have been used for architectural glass units in the past, they have not been used in the configuration illustrated in FIG. 12.

If desired, an optional leg 164 can be provided on the structural glazing bar 154 to provide further support for the structural gasket. Also as shown, a backing material 165 is inserted in the gap between the adjacent edges of the glass lights prior to application of the weather seal 34. The use of such backing material is well known in the glazing industry and therefore its use need not be further described herein.

As will be apparent to those skilled in the art from the above description, applicant's new glazing construction offers distinct advantages over currently used glazing methods. Firstly, the metal surface of the sub-frame or mullion, which has caused considerable problems in the past, no longer requires the application of an adhesive thereto. Instead, a reliable mechanical fastening is provided for the material that is in contact with the metal surface. Secondly, the present method permits the use of a thin layer of adhesive between a rubber structrual gasket and the inner glass surface and it is easier to effect adhesion at this location. Reasons for this include the fact that heat or pressure can be used to produce a "cure" of the adhesive quickly. Also, stronger adhesive can be used where only a thin adhesive is required. In fact, a wide range of adhesives can now be used because flexiblity in the adhesive is no longer necessary.

As will be clear to those skilled in the glazing art, various modifications and changes can be made to the illustrated embodiments without departing from the spirit and scoep of this invention. Accordingly, all such modifications and changes as fall within the scope of the appended claims form part and are intended to form part of the present invention.

I claim:

1. A glass unit comprising:

a glass light having an inner surface;

an elastomeric, elongate gasket extending along edges of said glass light and located adjacent said inner surface;

a thin adhesive layer bonding said glass light to said gasket and located between said glass light and said gasket; and an elongate supporting frame of rigid material extending along the same edges of said glass light and located on the side of said gasket opposite said glass light, said frame including integral flanges which extend into and are essentially non-removably, structurally united with the body of said elastomeric gasket for mechanically fastening said gasket to said frame;

said gasket being of sufficient flexibility to accommodate relative movement between said glass light and said frame, thereby reducing stresses to said adhesive layer.

2. A glass unit according to claim 1 wherein said integral flanges for mechanically fastening said gasket comprises L-shaped flanges integrally formed on said frame and rolled into sealing engagement with said gasket.

3. A glass unit according to claim 1 wherein said adhesive layer is formed by an adhesive of the chemical molecular linkage type.

4. A glass unit according to claim 1 unit comprising a single glass light.

5. A glass unit according to claim 1 unit comprising a double glazing sealed unit.

6. A glass unit according to claim 1 wherein said supporting frame is made of aluminum and has not been surface treated or primed along the surface immediately adjacent said gasket.

7. A glass unit according to claim 1 wherein said flexible gasket is made of heat cured silicone or Neoprene.

8. A glass unit according to claim 1 wherein said structural gasket has a longitudinally extending cavity which is open on the side of said gasket opposite said glass light and said integral flanges comprise an outwardly projecting longitudinally extending extension of said frame, said extension being arranged in said cavity and having outer edge flanges extending back towards said frame.

9. A glass unit according to claim 8 wherein said flanges tightly engage portions of said structural gasket disposed between said outer edge flanges and a central section of said extension.

10. A glass unit according to claim 1 wherein said structural gasket has a ribbed extension means on the side thereof opposite said glass light and said integral flanges comprise ribbed flanges projecting outwardly from the side of said frame facing said gasket, said flanges securely engaging said extension means.

11. A glass unit according to claim 10 wherein said extension means comprises two spaced-apart ribbed extensions and said flanges including two outer flanges arranged on the outside of said extensions and a central flange arranged between said two extensions.

12. A glass unit according to claim 1 wherein said integral flanges comprise longitudinally extending flanges projecting outwardly from the side of said frame facing said gasket, said longitudinally extending flanges having clamping teeth disposed on inner surfaces thereof and wherein said structural gasket has longitudinally extending extension means on the side thereof opposite said glass light means, said extension means being tightly clamped in place between the longitudinally extending flanges.

13. A glass unit according to claim 12 wherein said integral flanges include a tooth-covered central rib disposed midway between said longitudinally extending flanges and said extension means comprise two spaced-apart extensions located on opposite sides of said central rib.

14. Apparatus for securing a glass light to a support member adjacent an edge area of the glass light comprising:

a glass light having an edge area;

an elongate sub-frame element extending along and in spaced parallel relationship with said edge area;

an elongate, high-strength, elastomeric gasket disposed between said sub-frame element and said edge area;

said gasket and said sub-frame being mechanically structurally joined by sub-frame flange elements which extned into and are essentially nonremovably joined with the body of said gasket;

means adhesively bonding the gasket to said edge area; and means for removably securing the sub-frame to said support member whereby the gasket absorbs movments between the glass light and sub-frame element thereby reducing stresses to without the adhesvie bond between the gasket and glass light edge area.

15. A glass unit according to claim 1 wherein said gasket has tension stiffness less than 2000 pounds/inch/inch.

16. A panel unit for use on a building exterior comprising:

a glass panel member having an inner surface;

a flexible structural gasket of elastomeric material extending along edges of said panel member and located adjacent said inner surface;

a thin adhesive layer bonding said panel member firmly to said structural gasket; and a supporting frame of rigid material extending along the same edges of said panel member and located on the side of said structural gasket opposite said panel member whereby the panel member has a flush exterior, said frame including means for mechanically uniting said gasket with said frame;

said gasket being of sufficient size and elasticity as to accommodate relative movement in all directions between the panel and frame thereby reducing stresses jto the adhesive layer.

17. A glass unit according to claim 14 wherein the material forming said gasket has a modulus of elasticity of less than 1000 pounds per square inch.

18. A panel unit according to claim 16 wherein said gasket has a tension stiffness less than 2000 pounds/inch/inch.

19. A panel unit according to claim 16 wherein said panel member is a metal panel.

20. A glass unit comprising:

glass light means having an inner surface;

a flexible structural gasket extending along edges of said glass light means and located adjacnet said inner surface;

said structural gasket having a longitudinally extending recess along one side thereof adapted to receive part of a supporting frame member, said one side of such gasket being adjacent a respective edge of said glass light means and extending perpendicular to said inner surface;

said structural gasket further having a longitudinally extending groove along another side thereof;

a thin adhesive layer bonding said glass light means firmly to said gasket; and elongate locking strip means having a length corresponding to that of said groove and a cross section sized and shaped to permit said strip means to fit snugly in said groove and to thereby firmly attach said structural gasket to said supporting frame member, wherein said groove has a cross-sectional shaped formed to retain said locking strip means in said groove after said strip means is inserted therein.

21. A glass unit according to claim 1 wherein said flexible structural gasket is made of Neoprene.

22. A panel unit according to claim 17 wherein the material forming said gasket has a modulus of elasticity of less than 1000 pounds per square inch.

23. Apparatus for securing a glass light according to claim 21 wherein said gasket has a tension stiffness less than 2000 pounds/inch/inch.

* * * * *